US006055977A

United States Patent [19]

Linard

[11] Patent Number: 6,055,977

[45] Date of Patent: May 2, 2000

[54] WINDOWS OR THE LIKE OF HEATERS, THESE WINDOWS OR THE LIKE BEING EQUIPPED WITH AN EXPANSION COMPENSATION DEVICE, AND DEVICE FOR THIS PURPOSE

[75] Inventor: Gerard Linard, Monceau Imbrechies, Belgium

[73] Assignee: Thermic Investment, Luxembourg, Luxembourg

[21] Appl. No.: 09/183,400

[22] Filed: Oct. 30, 1998

[30] Foreign Application Priority Data

Oct. 31, 1997 [EP] European Pat. Off. ..... 97203396

[51] Int. Cl.[7] ..... F23M 7/00; F24B 1/192; F27D 1/00

[52] U.S. Cl. ..... 126/200; 126/544; 126/545; 52/573.1; 52/204.591; 52/204.599; 52/204.6; 52/202; 432/251; 432/247; 432/250

[58] Field of Search ..... 126/190, 198, 126/200, 544, 545, 547, 543; 52/573.1, 204.59, 204.591, 204.599, 204.6, 204.69, 127.12, 202, 204.51; 313/404, 405, 406, 407; 428/34; 219/391; 432/251, 247, 250

[56] References Cited

U.S. PATENT DOCUMENTS

| | | | |
|---|---|---|---|
| 1,013,390 | 1/1912 | Huenefeld | 126/200 |
| 1,016,566 | 2/1912 | Huenefeld | 126/200 |
| 1,017,196 | 2/1912 | Balioan | 126/200 |
| 1,813,162 | 7/1931 | Hoegger | 52/202 |
| 1,887,654 | 11/1932 | Mahon | 126/200 |
| 2,047,086 | 7/1936 | Stephens | 52/202 |
| 2,122,453 | 7/1938 | Clause | 126/200 |
| 2,456,486 | 12/1948 | Berghoff | 52/202 |
| 2,580,957 | 1/1952 | Reeves | 126/200 |
| 2,747,568 | 5/1956 | Dupler | 126/200 |
| 3,789,825 | 2/1974 | Reiner | 52/202 |
| 3,935,497 | 1/1976 | Cowles et al. | 313/405 |
| 4,121,379 | 10/1978 | Everson | 52/202 |
| 4,143,493 | 3/1979 | Booi | 52/127.12 |
| 4,300,528 | 11/1981 | Slemmons | 126/200 |
| 4,572,983 | 2/1986 | Ragland, Jr. | 313/405 |
| 5,394,052 | 2/1995 | Oh | 313/405 |
| 5,477,646 | 12/1995 | Dietz et al. | 52/202 |

FOREIGN PATENT DOCUMENTS

0446792 A2 9/1991 European Pat. Off. .

*Primary Examiner*—Ira S. Lazarus
*Assistant Examiner*—David Lee
*Attorney, Agent, or Firm*—Knobbe, Martens, Olson & Bear, LLP

[57] ABSTRACT

Disclosed is a window construction for a heater, which generally has a frame and at least one panel fitted on the frame. The frame and the at least one panel are usually made of different materials having different expansion coefficients. An expansion compensator made of bimetallic material is provided to the window located between the frame and a distal portion of the at least one panel to otherwise contact the frame. The expansion compensator compensates the differential expansions occurring between the frame and the at least one panel as the heater temperature changes.

13 Claims, 4 Drawing Sheets

WINDOWS OR THE LIKE OF HEATERS, THESE WINDOWS OR THE LIKE BEING EQUIPPED WITH AN EXPANSION COMPENSATION DEVICE, AND DEVICE FOR THIS PURPOSE

SUBJECTS OF THE INVENTION

The present invention relates to windows, casement doors, paneled doors and other similar elements of heaters, these windows and doors being equipped with a compensation device for correcting the effects of differential expansion.

The invention also relates to a device for windows, casement doors and paneled doors which is intended for heaters.

In the description which follows, the term "window" will be used in its broadest sense to include casement doors, paneled doors and the like comprising a part, which is generally glazed, housed in a frame, generally swing- or pivot-hung but which may also be fixed.

TECHNOLOGICAL BACKGROUND

So-called open-fire heaters are, as is known, very attractive to the users, this attraction being the result of the visual effect of the flames during combustion.

Unfortunately, it is also known that heaters of this type exhibit very mediocre efficiency and attempts at creating fireplace fires or stoves which have a window or the like have therefore been made. Such a window consists of a frame containing one or more transparent or possibly translucent panels, generally made of glass or vitreoceramic, or even sometimes opaque panels if a visual effect is not sought, these types of panels having a coefficient of expansion which, in general, differs from that of the frame.

When the panel is made of a single piece, sealing between this panel and the frame is obtained by a somewhat flexible gasket acting under pressure, tension or sliding.

Now, what happens is that the temperature variations cause differential expansion between the frame and its contents, the coefficient of expansion of which differs from that of the frame. In theory, these expansions should be left to take effect with a certain amount of freedom in order to avoid excessive mechanical loadings which could cause cracking or breakage.

This is as true of flat panels as it is of bowed, curved or prismatic panels, provided they are still of one piece.

When the transparent or translucent constituent part is made up of a number of contiguous pieces or panels, a gap always occurs between them because the expansion of the frame exceeds that of the material of which the panels are made. This gap is eminently prejudicial to sealing and causes other drawbacks, especially emanations of gases, deposits and soiling.

In document EP 0 446 792 A2, it has been proposed that there be used, for a tube intended for a color television which has an evacuated envelope and a fixture comprising a mask. [sic] The device for fitting the mask is produced, for a better ability to withstand shocks and vibrations, in the form of a system made of bimetallic materials.

A similar system is described in document U.S. Pat. No. 3,935,497-A.

It should first of all be noted that such a device comes from a technical field that is entirely different from the heaters that are the subject of this application. In any case, tubes of this type do not involve differences in thermal expansion which are of the same order of magnitude as those of the invention, and the problems of sealing between the frame and one-piece panels and especially panels made up of several pieces that it contains, do not arise.

OBJECTS OF THE INVENTION

The object of the invention is to solve the mentioned problems of differential expansion and, in particular, to compensate for this expansion while maintaining sealing, without leading to major technical complications and to do so while at the same time ensuring good durability under conditions of relatively high thermal stress.

The situation is that fires or stoves of the aforementioned type may reach temperatures in excess of 300 or 400° C., depending on the fuel used and on the operating conditions, starting from a fire which, before it is started, may be at temperatures below 0° C.

In particular, starting from the assumption that a fire or stove may easily, for normal use, have a life in excess of 10 years, it is propitious that the device used should be capable of maintaining its characteristics throughout the life without requiring replacement as a result of wear.

The invention is able to satisfy the abovementioned requirements.

CHARACTERISTIC FEATURES OF THE INVENTION

The invention relates to a window intended, in particular, for the glazed parts of a heater, this window consisting of a frame containing one or more panels with coefficients of expansion which differ from that of the frame, characterized in that it comprises an expansion compensator made of bimetallic materials acting on the panel or panels by resting against the frame so as to provide sealing between said frame and the panel or panels and between the individual panels.

The invention also relates to the device for compensating for the differential expansions that occur between the frame and one or more panels mounted in or on this frame used in particular to produce a window or the like in a heater, characterized in that it consists of a bimetallic material in the form of a bimetallic strip.

Other embodiments of the invention will become clear from reading the description which follows and the claims.

The term "frame" should be understood in its broadest sense in the description of the invention and of the claims, as also including a window skeleton generally, in the case of a heater, consisting of a decorative element such as fake wrought-iron work imitating an old-fashioned fire screen, firedog, etc.

Likewise, the term "window" should also be understood in the broadest sense as defined hereinabove.

Bimetallic materials of the bimetallic strip type are well-known and very widely used even at high temperatures of several hundreds of degrees. These devices under the effect of a variation in temperature, cause a bending of the strip which is put to good use, particularly in thermostats and in circuit breakers.

In some instances too, this device has been proposed for acting directly on flow regulators.

The bimetallic strip consists of two strips of metal, each of which has a different thermal expansion coefficient. When the temperature of the bimetallic strip goes up, one of the two strips making up the bimetallic strip will expand more than the other, distorting the bimetallic strip and causing it to bend in the direction of the side with the metal having the lower thermal expansion coefficient.

In the specific application proposed by the invention, the particular property of the bimetallic strip is put to use in such a way that when it is subjected to an increase in temperature which results in differences in expansion between the panel and the structure against which it rests, the action of the bimetallic strip provides the compensation needed for this difference in expansion.

This then gives a means which is at the same time simple, effective and not very sensitive to wear for compensating for the differences in expansion without exerting excessive force on the panel and/or on the support.

In the specific case of a frame which comprises a number of panels, these panels are held in a contiguous position, ensuring sealing.

By a suitable choice of the expansion characteristics and the sizing of the bimetallic strip, it is possible easily, for the field of heaters, to produce effective compensation in the temperature ranges that are usual for this type of appliance.

The invention will be described in greater detail with reference to some preferred embodiments with reference to the appended drawings.

In the various figures, identical reference labels are used for constituent parts which are identical or similar. Not all of the reference labels are repeated in the various views, for reasons of clarity of the drawings.

DESCRIPTION OF THE PREFERRED EMBODIMENTS OF THE INVENTION

A window shown by the general label 1 consists of one, or generally a number of, panels 5, mounted in the frame 3 or held on the frame 3 when this frame is, in fact, a window skeleton.

To compensate for the differential thermal expansions between the frame 3 and the panels 5, one or more bimetallic strips 9 resting against the frame 3 are used to keep the individual panels 5 contiguous.

Figure 1:
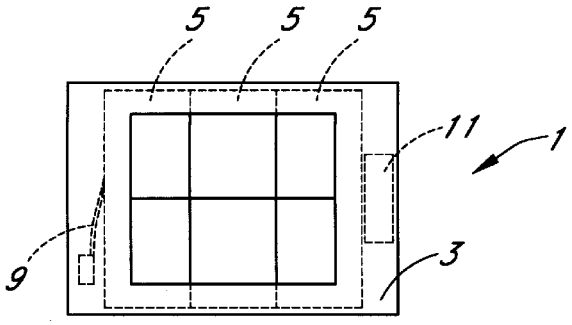
FIG. 1: a front view of a window made up of three panels and of a compensator.

In the case of FIG. 1, intended for a small window, the bimetallic strip 9 pushes the three panels 5 laterally toward a buffer 11.

Figure 2:
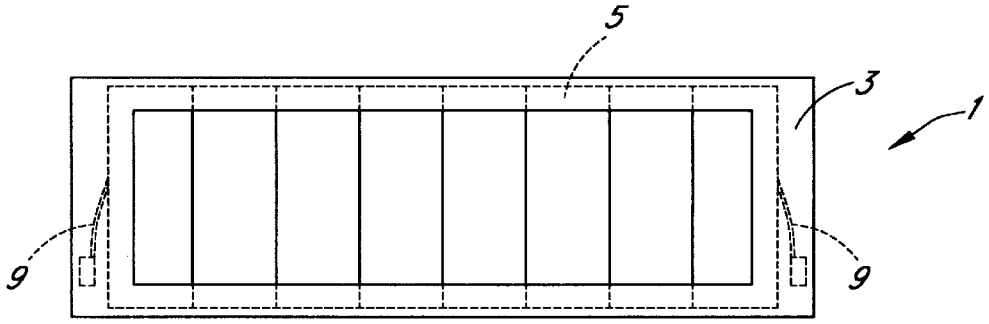
FIG. 2: a front view of a longer window made up of eight panels and of two compensators.
Figure 3:
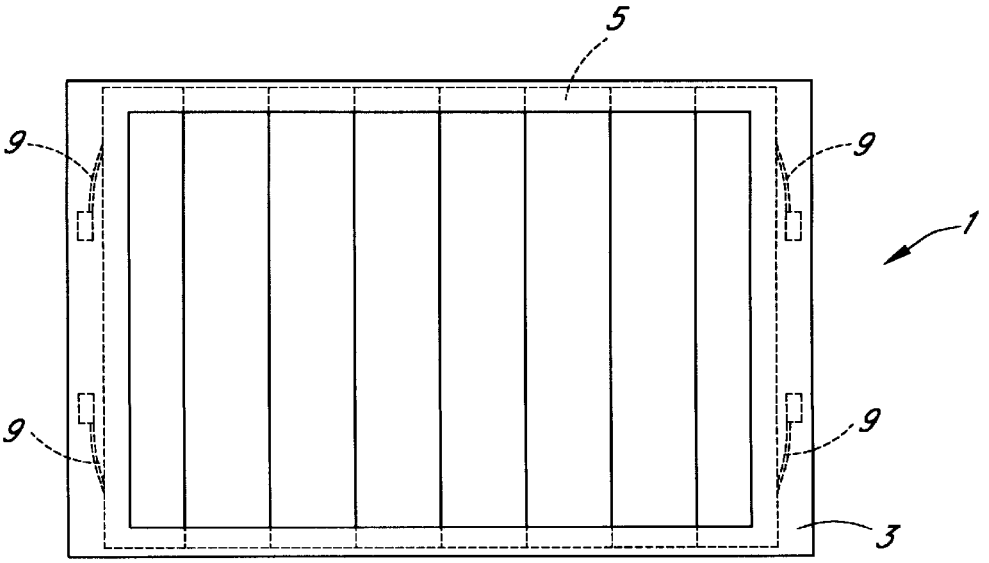
FIG. 3: a front view of a longer and taller window made up of eight panels and of four compensators arranged in two pairs.
Figure 4A:
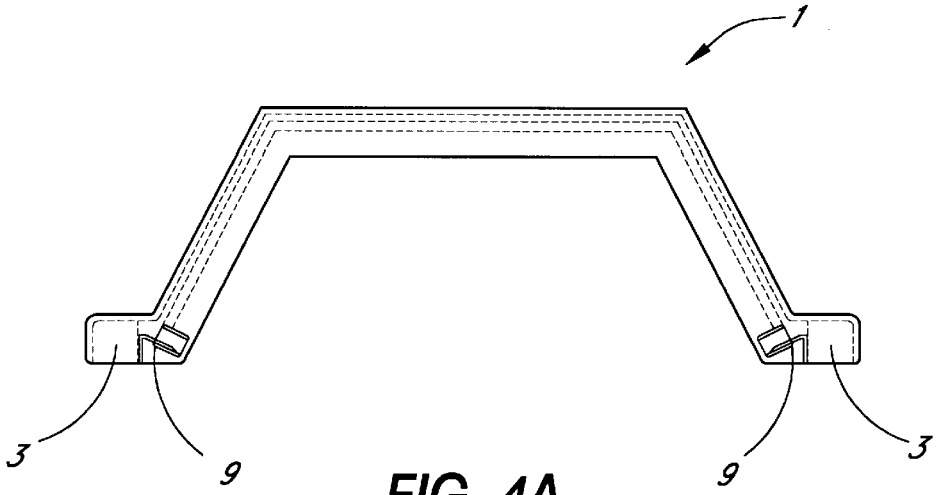
FIG. 4A: an elevation of a window comprising a prismatic glazed part with rectangular leaves in three parts.
Figure 4B:
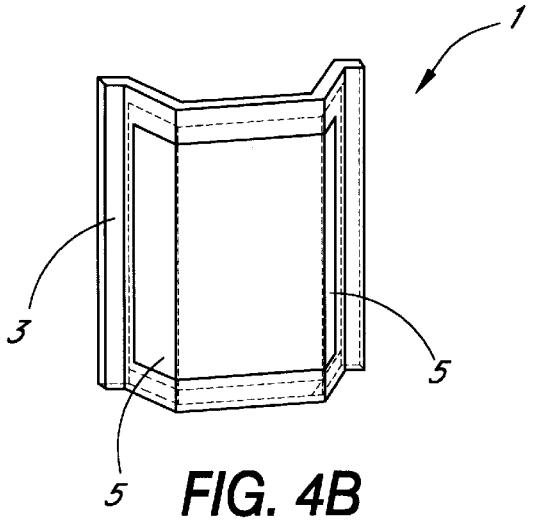
FIGS. 4B, 5B and 6B: perspective views corresponding to FIGS. 4A, 5A and 6A respectively.
Figure 5B:
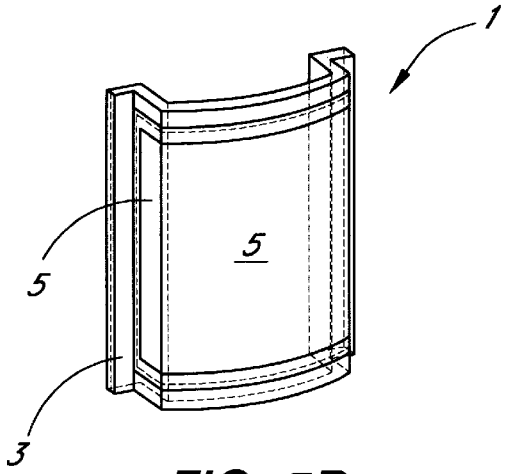
Figure 5A:
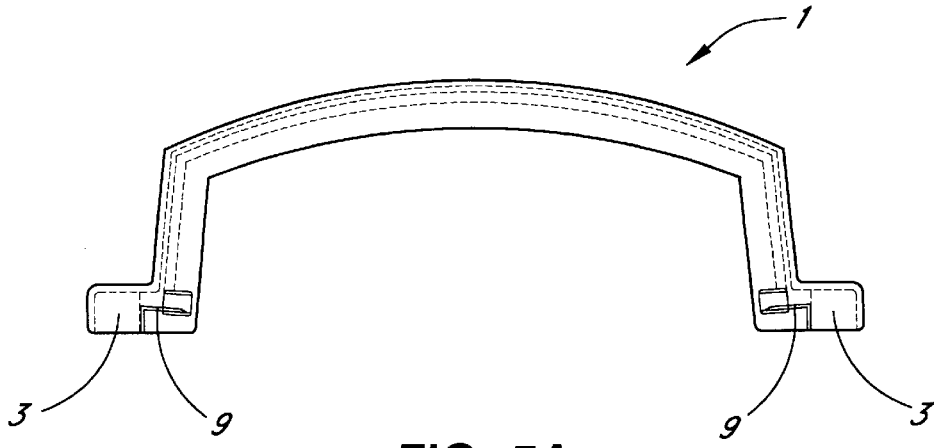
FIG. 5A: an elevation of a window comprising a slightly domed glazed front part and two flat lateral parts.
Figure 6A:
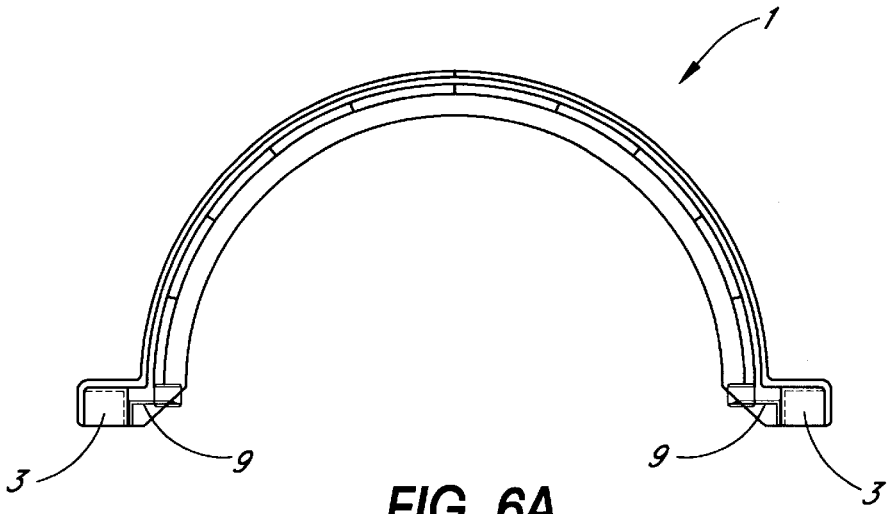
FIG. 6A: an elevation of a window comprising a domed glazed part made of rectangular leaves in more than three parts mounted in a sliding frame.
Figure 6B:
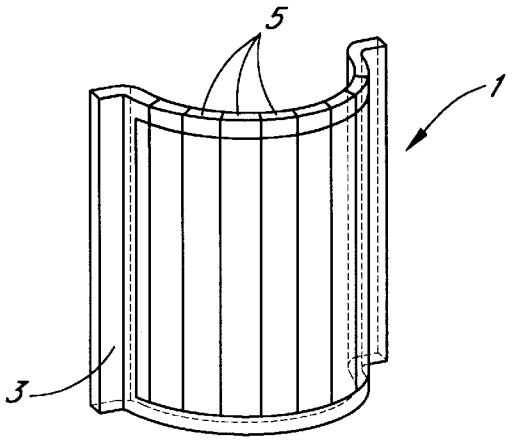
Figure 7:
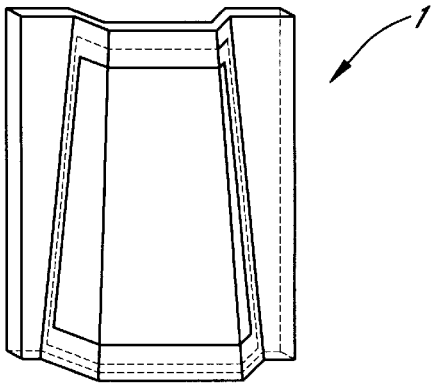
FIG. 7: a front view comprising a prismatic glazed part with non-rectangular (truncated pyramid-shaped) leaves made in three parts.
Figure 8:
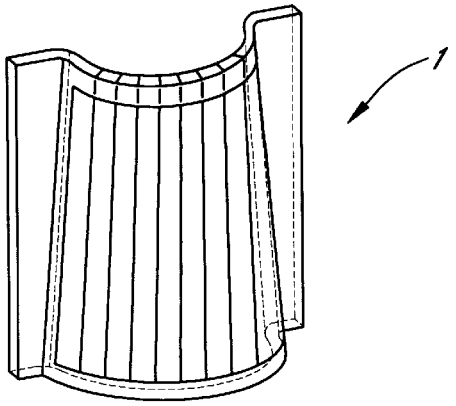
FIG. 8: a perspective view of a window comprising a prismatic glazed part with non-rectangular (truncated pyramid-shaped) leaves in more than three parts on a sliding frame.

In the case of FIGS. 2 and 3, the bimetallic strip or strips on one side also act laterally, but in the opposite direction to the bimetallic strips on the opposite side.

Figure 9A:
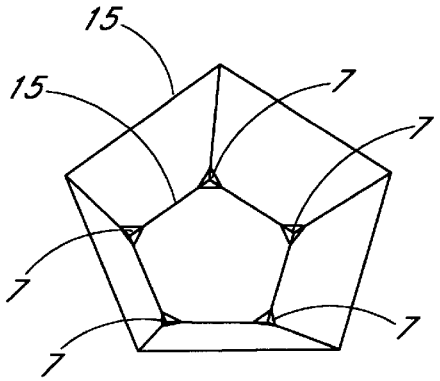
FIGS. 9A and 9B: a "bug-eye" window in which the vertex trihedrons are pulled toward the window skeleton by means of bimetallic strips.
Figure 9B:
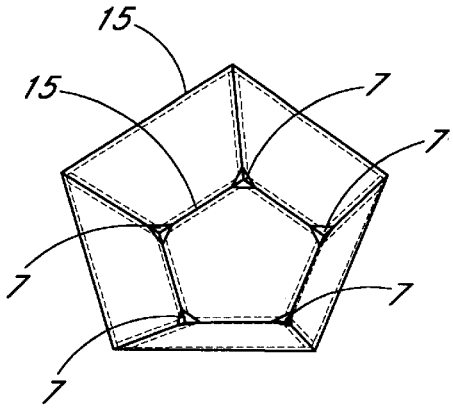
Figure 10A:
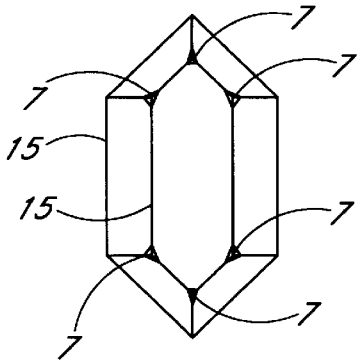
FIGS. 10A and 10B: an emerald window in which the vertex parts are pulled toward the internal skeleton.
Figure 10B:
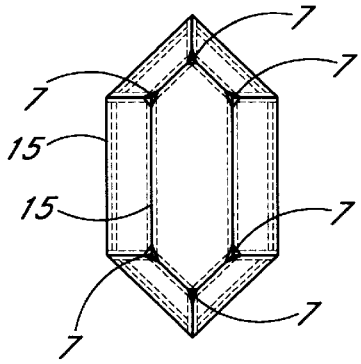

FIGS. 9A and 9B illustrate a "bug-eye" window and FIGS. 10A and 10B illustrate an emerald window in both of which the vertex trihedrons 7 are pulled towards the window skeleton 15 by means of bimetallic strips. For the sake of clarity, the bimetallic strips have not been represented in these Figures. Instead, an example of a vertex connection using a bimetallic strip is shown in FIG. 11.

Figure 11:
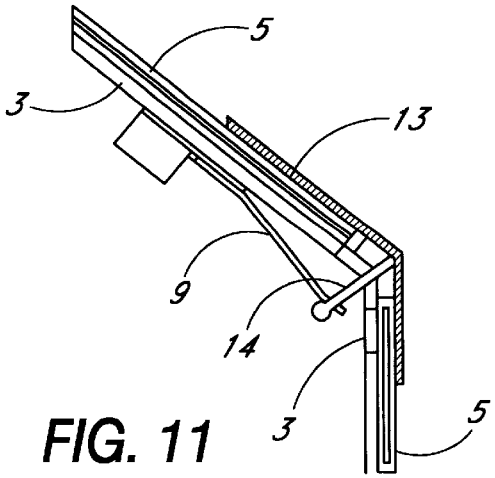
FIG. 11: a view of the mounting of a bimetallic strip in a frame fitted with glazed panels.

In the embodiment of FIG. 11, the distal part of the bimetallic strip 9 expands outwardly with respect to the frame and thus pulls, by means of a connection to 14, on the angular element, maintaining in contact the panels 5 and the frame 3, which is the window skeleton.

Although illustrative embodiments of the invention have been described, it must be clearly understood that other embodiments of these are possible within the scope of the claims which follow.

I claim:

1. A window for a heater comprising a frame, at least one panel, and a bimetallic strip serving as an expansion compensator, the at least one panel being fitted on the frame, the at least one panel having an expansion coefficient different from that of the frame, the expansion compensator being in contact with the frame and a distal portion of the panel so that the expansion compensator acts on the at least one panel against the frame when the frame and the at least one panel expand or shrink as the heater temperature changes.

2. A window as defined in claim 1, wherein one end of the strip is connected to the frame and the other end of the strip is connected to the distal portion of the panel.

3. A window as defined in claim 1, wherein a buffer is provided in contact with an opposite distal portion of the panel which otherwise contacts the frame.

4. A window as defined in claim 1, wherein the at least one panel comprises a plurality of panels, and the plurality of panels is contiguously fitted on the frame, thereby sealing between the neighboring panels is achieved by the expansion of the expansion compensator.

5. A method for providing a window for a heater, comprising:

providing a window frame;

attaching a bimetallic strip as an expansion compensator to the window frame; and fitting at least one panel on the window frame such that a distal portion of the panel is in contact with an opposite distal portion of the panel which otherwise contacts the frame.

6. A method as defined in claim 5, further comprising the step of providing a buffer to be in contact with an opposite distal portion of the panel which otherwise contacts the frame.

7. A method as defined in claim 5, wherein one end of the strip is attached to the frame and the other end of the strip is connected to the distal portion of the panel.

8. A method as defined in claim 6, wherein the buffer provided on the opposite distal portion of the panel is the expansion compensator made of a bimetallic material.

9. A method for compensating for the differential expansions occurring between a window frame of a heater and at least one panel fitted on the window frame, the method comprising:

providing a bimetallic strip as an expansion compensator to the window frame; and fitting the at least one panel on the window frame such that a distal portion of the panel is in contact with the expansion compensator.

10. A method as defined in claim 9, further comprising the step of providing a buffer to be in contact with an opposite distal portion of the panel which otherwise contacts the frame.

11. A method as defined in claim 9, wherein one end of the strip is attached to the frame and the other end of the strip is connected to the distal portion of the panel.

12. A method as defined in claim 10, wherein the buffer is made of a bimetallic material.

13. A method as defined in claim 12, wherein the buffer is a strip of the bimetallic material, wherein one end of the strip is attached to the frame and the other end of the strip is connected to the distal portion of the panel.

* * * * *